US005109812A

United States Patent [19]

Erickson et al.

[11] Patent Number: 5,109,812

[45] Date of Patent: May 5, 1992

[54] PNEUMATIC PRELOADED ACTUATOR

[75] Inventors: Frederick L. Erickson; William E. Richeson, both of Fort Wayne, Ind.

[73] Assignee: North American Philips Corporation, New York, N.Y.

[21] Appl. No.: 680,721

[22] Filed: Apr. 4, 1991

[51] Int. Cl.[5] ..... F01L 19/04

[52] U.S. Cl. ..... 123/90.12; 123/90.14

[58] Field of Search ..... 123/90.12, 90.14; 251/47

[56] References Cited

U.S. PATENT DOCUMENTS

| | | | |
|---|---|---|---|
| 4,852,528 | 8/1989 | Richeson et al. | 123/90.14 |
| 4,915,015 | 4/1990 | Richeson et al. | 123/90.14 |
| 5,058,538 | 10/1991 | Erickson et al. | 123/90.12 |

*Primary Examiner*—Noah P. Kamen

[57] ABSTRACT

A two position straight line motion actuator utilizes a double ended pneumatic spring to provide most of the energy required to transit back and forth between the two positions. The actuator is held in its initial position against the force of the pneumatic spring by hydraulic pressure applied to a latching piston. Transition from the initial or first position to the second position is initiated by opening a flow path around the latching piston to cancel the effects of the high pressure latch, thus allowing the air spring to power the actuator to its second position. As the actuator moves toward the second position, the second air spring dampens actuator motion converting the kinetic energy of the actuator moving portion into potential energy in the form of highly compressed air, thus cocking the second air spring. Return of the actuator is blocked by the fluid latch. Upon command, a valve opens the flow path around the latch, allowing the latch to release the actuator to return to its initial position. Supplemental hydraulic pressure is valved into the latching chamber during the latter part of travel of the moving portion of the actuator to overcome system friction and to assure that the actuator moves fully to its initial position. Both the speed and the distance traveled by the moving actuator portion may be controlled by pre-pressurization of the air chambers.

11 Claims, 6 Drawing Sheets

PNEUMATIC PRELOADED ACTUATOR

SUMMARY OF THE INVENTION

The present invention relates generally to a two position straight line motion actuator and more particularly to such an actuator which utilizes a double acting pneumatic spring to provide most of the energy required for the actuator to transit back and forth between the two positions. The pneumatic springs provide a high degree of energy conservation.

The prior art has recognized numerous advantages which might be achieved by replacing the conventional mechanical cam actuated valve arrangements in internal combustion engines with other types of valve opening mechanisms which could be controlled in their opening and closing as a function of engine speed as well as engine crankshaft angular position or other engine parameters.

In our copending application entitled HIGHLY EFFICIENT PNEUMATICALLY POWERED HYDRAULICALLY LATCHED ACTUATOR, Ser. No. 07/680,494 filed on even date herewith, there is summarized a great deal of prior art, as well as our previous developments as disclosed in pending patent applications all of which has contributed to the evolution of the present invention.

In the devices of certain of these applications, air is compressed by piston motion to slow the piston (dampen piston motion) near the end of its stroke and then that air is abruptly vented to atmosphere. When the piston is slowed or damped, its kinetic energy is converted to some other form of energy and in cases such as dumping the air compressed during damping to atmosphere, that energy is simply lost. U.S. Pat. No.4,883,025 and 4,831,973 disclose symmetric bistable actuators which attempt to recapture some of the piston kinetic energy as either stored compressed air or as a stressed mechanical spring which stored energy is subsequently used to power the piston on its return trip. In either of these patented devices, the energy storage device is symmetric and is releasing its energy to power the piston during the first half of each translation of the piston and is consuming piston kinetic energy during the second half of the same translation regardless of the direction of piston motion. More importantly, in each of these cases, there is a source of energy for propelling the piston in addition to that supplied by the energy storage scheme.

Our recent invention disclosed in U.S. Ser. No. 07/557,370, filed Jul. 24, 1990 entitled ACTUATOR WITH ENERGY RECOVERY RETURN propels an actuator piston from a valve-closed toward a valve-open position and utilizes the air which is compressed during the damping process to power the actuator back to its initial or valve-closed position. Moreover, an actuator capture or latching arrangement, such as a hydraulic latch, is used in this recent invention to assure that the actuator does not immediately rebound, but rather remains in the valve-open position until commanded to return to its initial position. The initial translation of the actuator piston in this recent application is powered by pneumatic energy for an air pump and requires relatively large source pump as well as relatively large individual valve actuators.

Our recent invention as disclosed in U.S. Ser. No. 07/557,369 filed Jul. 24, 1990 and entitled HYDRAULICALLY PROPELLED PNEUMATICALLY RETURNED VALVE ACTUATOR takes advantage of many of the developments disclosed in the contemporaneously filed ACTUATOR WITH ENERGY RECOVERY RETURN application while the initial powered translation is accomplished by hydraulic energy from a hydraulic pump rather than by pneumatic energy. Hydraulic energy propulsion yields the advantages of reduced actuator size and, therefore, is easier to package, as well as a reduction of the size of and, therefor, the space required underneath a vehicle hood by the hydraulic pump. Also, in furtherance of the goal of reduction in size, the compression of latching air and pneumatic energy recovery feature is accomplished in a smaller chamber than taught in our ACTUATOR WITH ENERGY RECOVERY RETURN application. The reduction in size is accompanied by a correlative increase in peak pressure of the compressed air. The latching pressure must be correspondingly increased, and in particular, a decrease in piston diameter to one-half the former value requires a corresponding four-fold increase in pressure to maintain the same overall latching force.

In the HIGH EFFICIENT PNEUMATICALLY POWERED HYDRAULICALLY LATCHED ACTUATOR, as in certain of our prior inventions, a hydraulic latch locks the power piston in its second (engine valve open) position after that power piston has compressed a quantity of air in moving from its initial (engine valve seated) position. This represents a significant departure from the prior art in using a modified latch to obtain the additional function of latching and pneumatic energy storage in the first or poppet valve closed position as well. This double latching feature requires a second set of control valves which operate in a second channel. Since almost all of the energy of compression which is captured during the initial transit can be used to power the actuator back to its initial position and most of the compression energy can also be captured by the second latch on the return stroke, this actuator design represents an improvement in theoretical efficiency over the other methods that have been disclosed. The permanent magnet latching schemes so common in many of our earlier applications have, as in the ACTUATOR WITH ENERGY RECOVERY RETURN and HYDRAULICALLY PROPELLED PNEUMATICALLY RETURNED VALVE ACTUATOR applications, been eliminated along with their associated cost and weight. The device of this copending application represents an advanced pneumatic actuator which is specifically configured to achieve a very high air usage efficiency. The methodology used to realize this includes powering the actuator in such a way that only a small quantity of thrusting air is lost during the first transit and to "catch" the piston with an automatic latch at the second position so that all the energy of compression is used to stop the piston. On command, the latch is released to return the actuator piston to its first position. Another feature of this application is the introduction of a small quantity of supplemental air by way of a one way valve which is actuated by the power piston at the end of its travel. The valve will automatically add sufficient air to pre-pressurize the power piston to the standard working source pressure. The piston is thus automatically pressurized and latched ready to begin its next round trip transit when the "activate" signal is received. The only pneumatic energy used is represented by that quantity of air used to bring the pressure of the returning piston back up to source pressure. A further feature of this disclosure is the incorporation of a design in which the power piston is directly connected to a double acting latch for the latching of the power piston in either of its extreme positions. This method of latching is intended to keep the piston from moving toward its other position rather than being a latch intended to simply pressurize and force the piston further into its present position.

In our copending application entitled SPRING DRIVEN HYDRAULIC ACTUATOR, Ser. No. 07/680,491 filed on even date herewith, there is disclosed an actuator which utilizes an air chamber to damp piston motion in either direction and then uses the just compressed air to power the piston back in the opposite direction. The invention of this copending application utilizes a hydraulic latch to hold the piston in one or the other extreme positions against the pneumatic force. The actuator of that application has a latching piston in a power module. The latching piston has an interconnecting shaft extending into a spring module in which a second piston functions as part of the hydraulic fluid spring assembly. The shaft extends beyond these modules and interconnects with an engine poppet valve. A shaft extension through the latching piston provides a means to power a reciprocating fluid control valve by means of interconnected helical springs. These springs provide forces on a latching armature which are in opposition to the forces applied to that armature by a pair of latching magnets.

The entire disclosures of all of the above identified copending applications and patents are specifically incorporated hereby reference.

In operation of the present invention, the energy of the first air spring is released to propel the actuator to its second position. Most of the kinetic energy of actuator motion is converted to potential energy in the second sprint. As the actuator reaches its second position, an automatic fluid latch locks a latching piston to prevent the actuator from bouncing backward. This latching feature is provided by a ball check valve which automatically closes in the event of a reversal of direction of fluid flow. The actuator remains in the second position until a command is received to open another valve which dumps the latching pressure and releases the actuator. Upon being released, the potential energy stored in the second pneumatic spring causes the actuator to rapidly transit back to the initial position. The system friction losses such as sliding friction and fluid losses are compensated for by supplemental hydraulic pressure which is automatically valved into the latching chamber during the final segment of the actuator's travel back to the first position. This valved in fluid provides a driving force behind the latching piston to assure that the air inside the first air spring is fully compressed and that an exemplary internal combustion engine poppet valve is fully seated. The only additional make-up energy required is derived from a small hydraulic pump which can produce a relatively high pressure but at a relatively small volume. The only point in the actuator cycle at which this supplemental pressure is supplied is during the latter part of the return stroke in which the added hydraulic pressure is valved into the unit to provide a positive valve seating and cocking of the air spring.

A variable air pressure may be introduced into each of the air springs. A port is located in the center of the air spring cylinder. Air pressure is applied to this port so that every time the piston opens the port, air can recharge the air spring chamber. The pressure can be adjusted to calibrate the force of the air spring and to also set the actuator speed and its stroke or displacement.

Among the several objects of the present invention may be noted the provision of variable actuation of a poppet valve using as little make-up energy as possible; the provision of a bistable actuator having a controllable location for one of its stable states; the provision of a bistable hydraulically latched actuator with an energy make-up provision which provides supplemental high pressure fluid at one end only of the actuator travel; and the provision of a bistable hydraulically latched actuator in accordance with the preceding object which utilizes the high pressure fluid to additionally secure the actuator in one of its bistable positions. These as well as other objects and advantageous features of the present invention will be in part apparent and in part pointed out hereinafter.

In general, a bistable hydraulically latched actuator mechanism has a reciprocable portion including a power piston and a latching piston, each having a pair of opposed working surfaces, with those two pistons being movable together back and forth between stable initial and second positions. There are symmetric first and second damping chambers in which air is compressed by the power piston alternately during translation of the mechanism portion back and forth between the initial and second positions with compression of the air in either damping chamber slowing the reciprocable portion movement and storing energy for subsequent propulsion of the power piston in an opposite direction. A hydraulic latching arrangement including the latching piston temporarily prevents reversal of the direction of movement of the reciprocable portion when the motion of that portion slows to a stop. This latching arrangement is disableable on command to allow the compressed air in a damping chamber to propel the reciprocable portion from one toward the other of its stable positions. Supplemental energy is added only once during each complete cycle to compensate for frictional losses when the reciprocable portion is near the initial position. This supplemental energy is in the form of additional hydraulic fluid under pressure which applies an additional force to one latching piston working surface and assure that the reciprocable portion remains in the initial position until commanded to change. During this time, a pressure release valve remains open to vent hydraulic pressure against the other latching piston working surface to a low pressure. A source of predetermined pressure air establishes the pre-compression pressure in each of the first and second damping chambers thereby determining the distance between the initial and second positions.

Also in general and in one form of the invention, an electronically controllable pneumatically powered spring valve actuating mechanism for use in an internal combustion engine of the type having engine intake and exhaust valves with elongated valve stems has a power piston fixed to the engine valve which reciprocates along a common axis. The piston is moved by a pneumatic arrangement which causes the engine valve to move in the direction of stem elongation between valve-closed and valve-open positions. There is a pneumatic damping arrangement for compressing a volume of air and imparting a continuously increasing decelerating force as the engine valve approaches one of the valve-open and valve-closed positions and this compressed volume of air is subsequently utilized to power the piston back to the other of the valve-open and valve-closed positions. A supplemental hydraulic arrangement is effective only when the engine valve is near the valve-closed position to supply hydraulic fluid under pressure to apply additional force to the engine valve to urge the engine valve securely into the valve-closed position and to supply additional energy to the mechanism once during each complete cycle to compensate for frictional losses.

Still further in general, an electronically controllable valve actuating mechanism for use in an internal combustion engine has a power piston with a pair of opposed faces defining variable volume chambers. The power piston is reciprocable along an axis and is coupled to an engine valve. A resilient damping arrangement which includes the power piston imparts a continuously increasing decelerating force as the engine valve approaches either of its valve-open and valve-closed positions. A hydraulic latching arrangement includes a latching piston having a pair of opposed working surfaces and a fluid transfer path between the working surfaces of the latching piston which may be closed on command to hold the power piston and engine valve in each of the stable positions, and opened on further command to allow free fluid flow between the two latching piston surfaces thereby allowing air compressed during the resilient damping to power the piston back from either of the valve-open and valve-closed positions to the other position.

BRIEF DESCRIPTION OF THE DRAWINGS

Corresponding reference characters indicate corresponding parts throughout the several views of the drawing.

Figure 1:
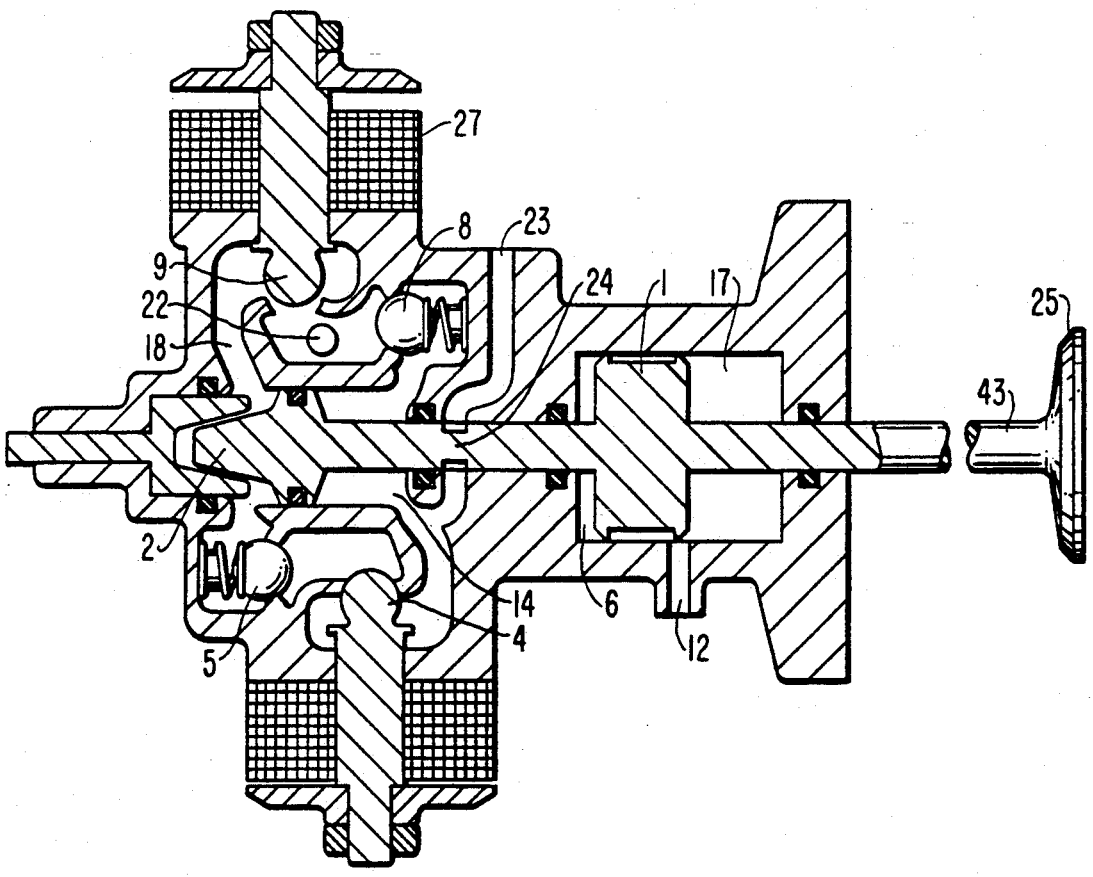
FIG. 1 is a view in cross-section of an actuator according to the present invention in its initial position.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

Referring to the drawing generally, a bistable electronically controlled transducer has an armature comprising latching piston 2, power piston 1 and shaft 43 which are interconnected and coupled to an engine poppet valve 25. This armature is reciprocable between second (engine valve closed as in FIG. 1) and first (engine valve open as in FIGS. 3 and 4) positions. A pneumatic arrangement including the piston 1 and compressed air in chamber 6 powers the armature from the first position to the second position while a second pneumatic arrangement including the piston 1 and compressed air in chamber 17 powers the armature from the second position back to the first position. Chamber 17 and piston 1 also function as a first pneumatic spring which is compressed during motion of the armature from the first position to the second position, with compression of that first pneumatic spring slowing armature motion as it nears the second position .Chamber 6 and piston 1 also function of the armature from the second position to the first position with compression of the second pneumatic spring slowing armature motion as it nears the first position .The air pressure in each pneumatic spring is preset at a predetermined value prior to compression. The hydraulic latch which includes the piston 2 along with ball valves 4, 5, 8, and 9 maintains pressure on the armature to temporarily prevent reversal of armature motion when the motion of the armature has slowed to a stop. Supplemental hydraulic pressure from source 23 is operable only when the armature is near the first or valve-closed position to supplying hydraulic fluid under pressure through shaft valve 24 to apply additional force to the armature to urge the armature securely into the first position and the engine valve 25 against its seat. This supplemental hydraulic pressure is effective to supply additional energy to the mechanism once during each complete cycle to compensate for frictional losses. The hydraulic latch is disableable on command to coil 29 to open ball valve 4 and allow the compressed first pneumatic spring (air compressed in chamber 17) to power the armature from the first position to the second position, and the hydraulic means and supplemental hydraulic pressure are disableable on command to coil 27 to allow the compressed second pneumatic spring to return the armature to the second or engine valve closed position.

Make-up energy is applied through shaft valve 24 directly to the fluid latching piston 2 to provide a final "cinching" pressure to the poppet valve insuring proper seating. A double ended air spring is incorporated to provide the initial energy necessary to propel the actuator to its second position. This spring is initially cocked by adding the make-up energy in the form of pressurized fluid against the latching piton during the final twenty-five percent of its travel.

FIG. 1 is an illustration of the actuator in its rest position in which the high pressure fluid has been ducted into chamber 14 from port 23 and shaft valve 24. This pressure applies a force against latching piston 2 in order to keep the poppet valve 25 seated. Ball valve 9 has been opened by electromagnetic actuator 27 to expose the exhaust port 22 to the pressure on the left side of piston 2. The ball valve actuators 27 and 29 may be spring biased toward the open position and comprise coils which are energized on command to neutralize the holding effect of permanent magnets, or may comprise coils which are normally energized holding the valves shut until a command to open in the form of de-energizing the coils. The exhaust port 22 functions as a pressure relief valve and assures a low pressure in chamber 18 and the differential pressure across valve 2 assures good valve seating in the initial or "at rest" position. Also in FIG. 1, the piston 1 is compressing the air in chamber 6.

This compressed air provides the initial propulsive energy. Port 12 is located near the center of the air piston chamber (6 and 17) to supply a regulated pre-pressurization of either chamber 6 or 17 depending on the position of piston 1. In FIG. 1, this pre-pressurization is of chamber 17 so that as the armature of the actuator with pistons 1 and 2 moves toward the right opening the engine poppet valve 25, the air in chamber 17 is compressed and the potential energy of that compressed air is used to propel the armature back to the engine valve closed position of FIG. 1.

Figure 2:
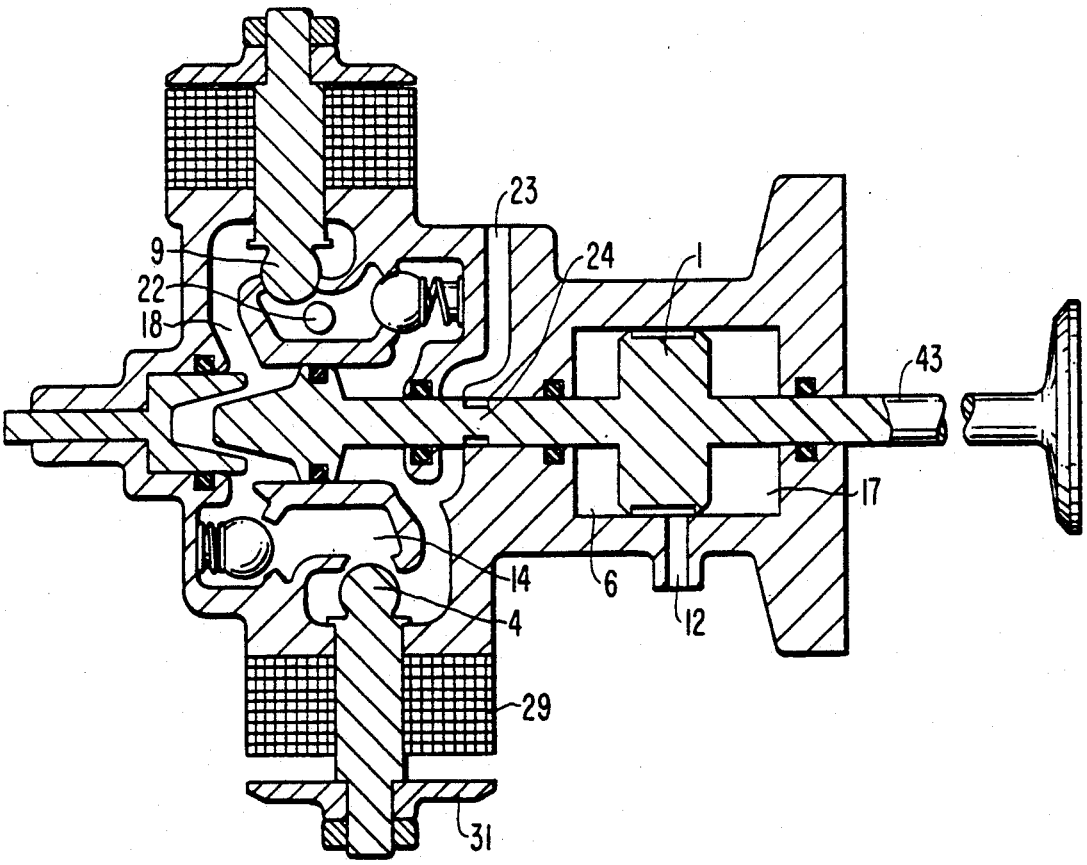
FIG. 2 is a cross-sectional view similar to FIG. 1, but showing the actuator enabled and beginning its transit to the second position.

In FIG. 2, the actuator has just been activated to begin opening poppet valve 25. The propulsion energy is stored as compressed air in chamber 6 (from compression in a previous transit). As soon as the fluid latch is released by energizing coil 29 to repel armature 41 thereby opening ball valve 4 and allowing the hydraulic fluid to circulate from chamber 14 into chamber 18, the compressed air will rapidly begin to accelerate the piston 1 toward the right. Comparing FIGS. 1 and 2, the sequence of events to activate the actuator are: the ball valve 9 must close to keep the high pressure fluid from short circuiting through the return port 22; the opening of ball valve 4 releases the fluid latch by first allowing the pressures in chamber 14 and 18 to stabilize at the same value and thereafter provide a closed circuit "race track" for fluid to move from chamber 14 around into chamber 18 as the piston 2 moves toward the right. As the main piston 1, latching piston 2, shaft and engine valve (collectively an armature or moving portion of the actuator) move toward the right the high pressure source or inlet port 23 is shut off by shaft valve 24 as it moves out of alignment with the inlet port 23. Pre-pressurization port 12 is also closed and the air in chamber 17 begins to be compressed accumulating energy in chamber which will be utilized during the return trip.

Figure 3:
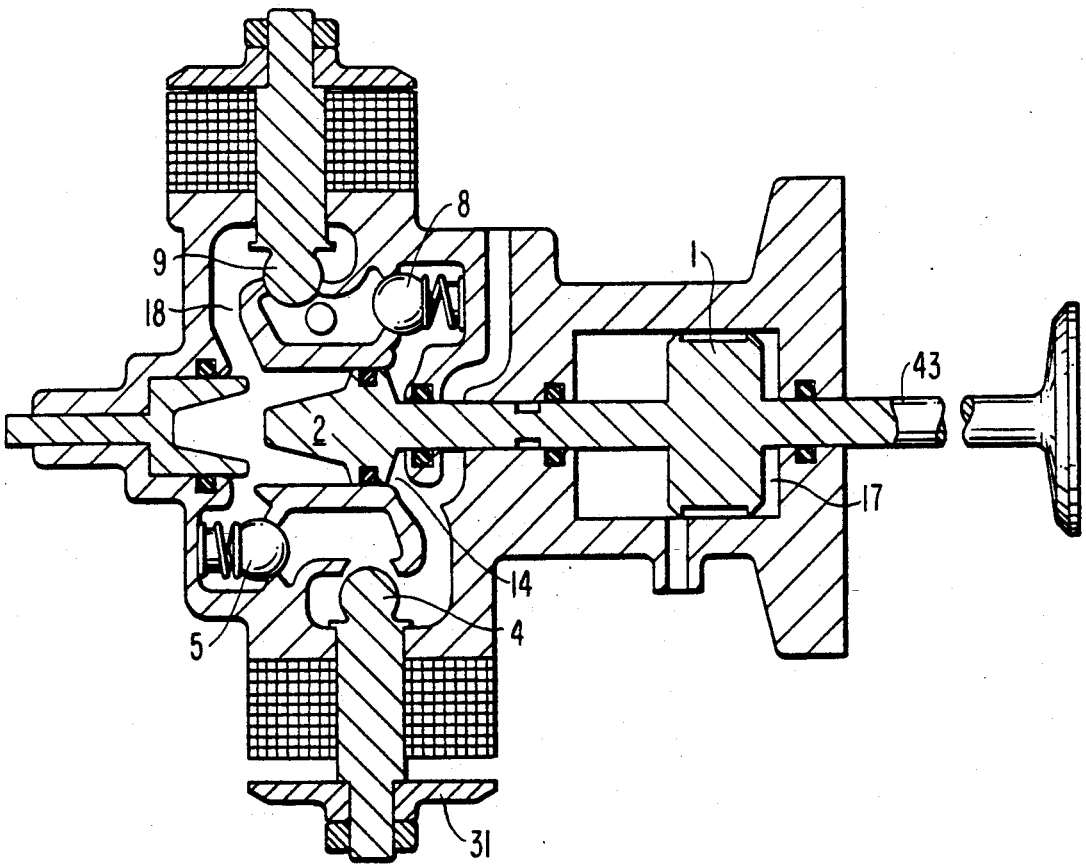
FIG. 3 is a view in cross-section similar to FIGS. 1 and 2, but showing the actuator as it is arriving at the second position.

FIG. 3 depicts the actuator as it reaches its extreme right hand position. This position is a point of equilibrium in which the compression energy stored in chamber 17 equals (neglecting losses) the prior propulsion energy. The piston 1 will attempt to rebound back to the left under the influence of this compressed air; however, the fluid latch will prevent any such rebound since leftward motion and an increase in the pressure in chamber 18 more firmly seats the ball valves 5 and 9. Still referring to FIG. 3, the ball valve 4 remains open for a short time to insure that the piston and shaft assembly has reached its furthest rightward position. A premature closing of valve 4 would cut off the circulation path venting chamber 14 into chamber 18 as piston 2 moves toward the right.

Figure 4:
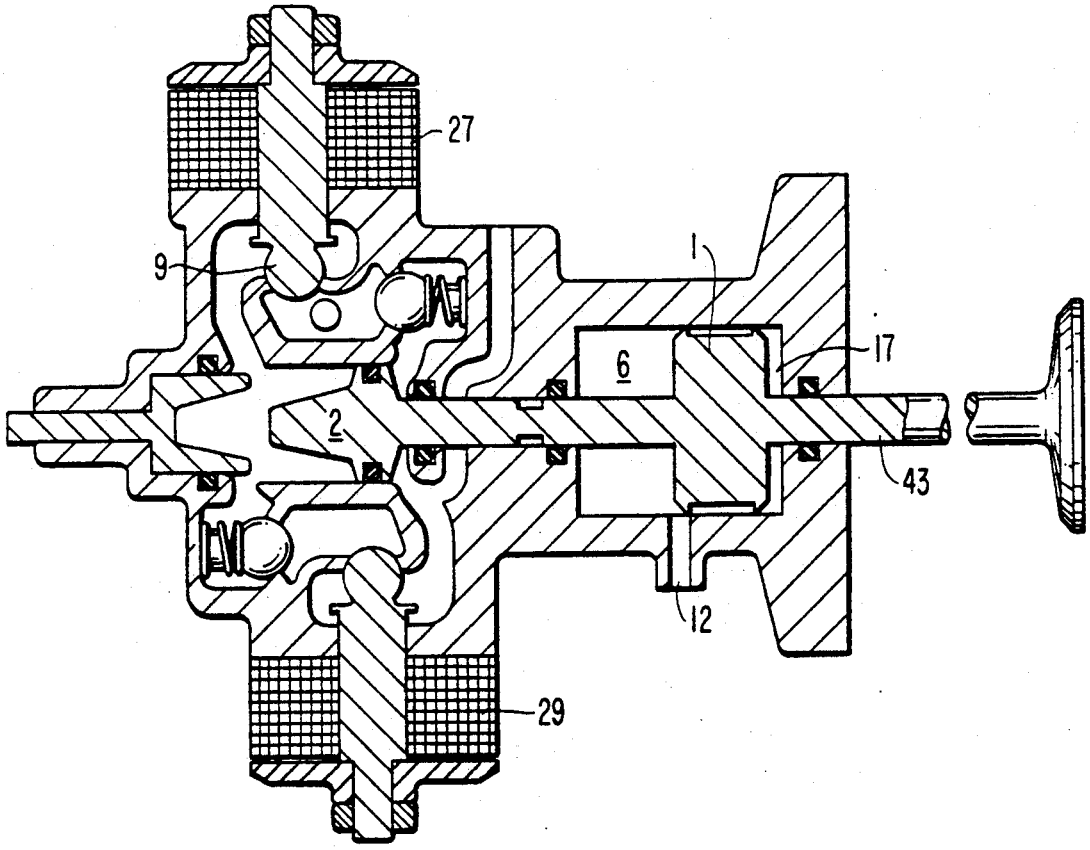
FIG. 4 is a cross-sectional view similar to the earlier views, but showing the actuator latched in the second position with all valves reset ready to accept a timed command to return to the first position.
Figure 5:
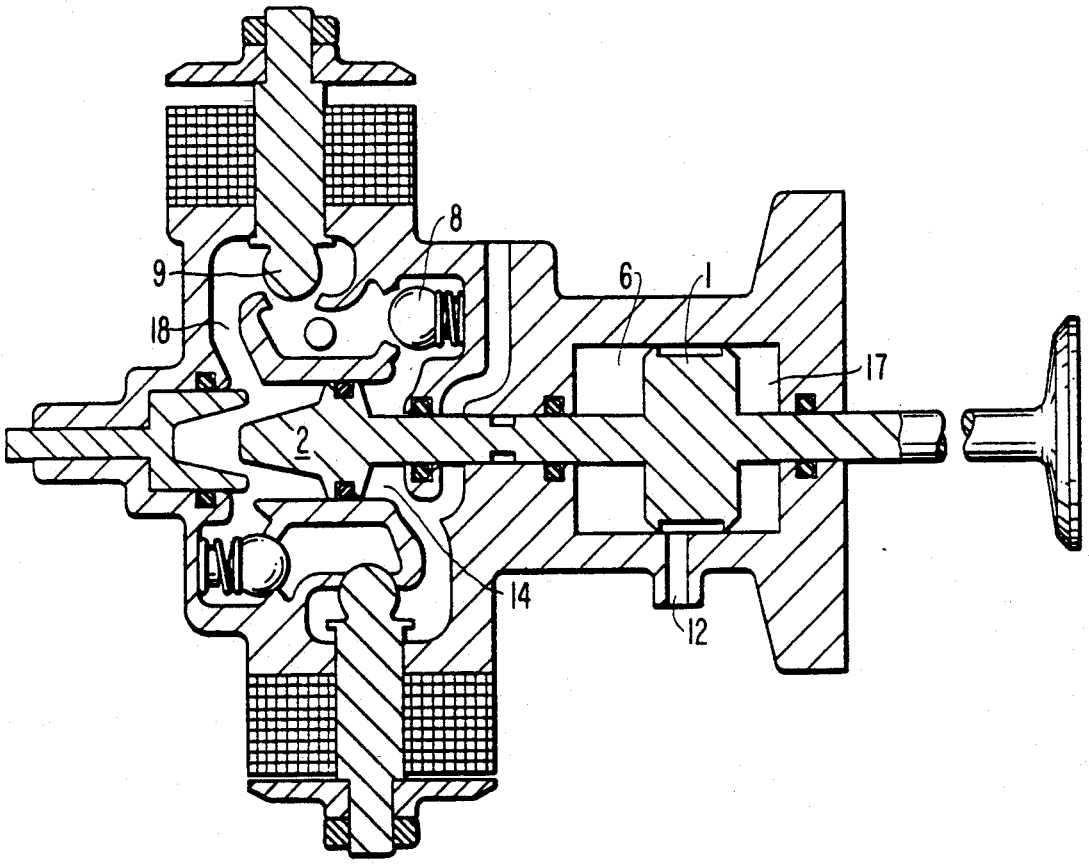
FIG. 5 is a cross-sectional view similar to the earlier views, but showing the actuator shortly after the fluid latch is released to allow the actuator to return to the first position.

In FIG. 4, the actuator piston is poised and ready to be sent back to its initial position by the energy stored in chamber 17. All four ball valves are closed and no motion will occur until a timed electrical signal is supplied to open valve 9 and release the latch. This opening of valve 9 is shown in FIG. 5 and when that valve opens, spring loaded check valve 8 also opens allowing the free circulation of fluid from chamber 18 into chamber 14. When the latch releases, the power piston 1 rapidly moves left toward its initial position. Comparing FIGS. 4 and 5 it will be noted that the pre-pressurized air which was supplied to chamber 6 through port 12 is being compressed as the armature moves leftwardly and this air continues to be compressed slowing the armature motion as it moves toward the position of FIG. 6.

Figure 6:
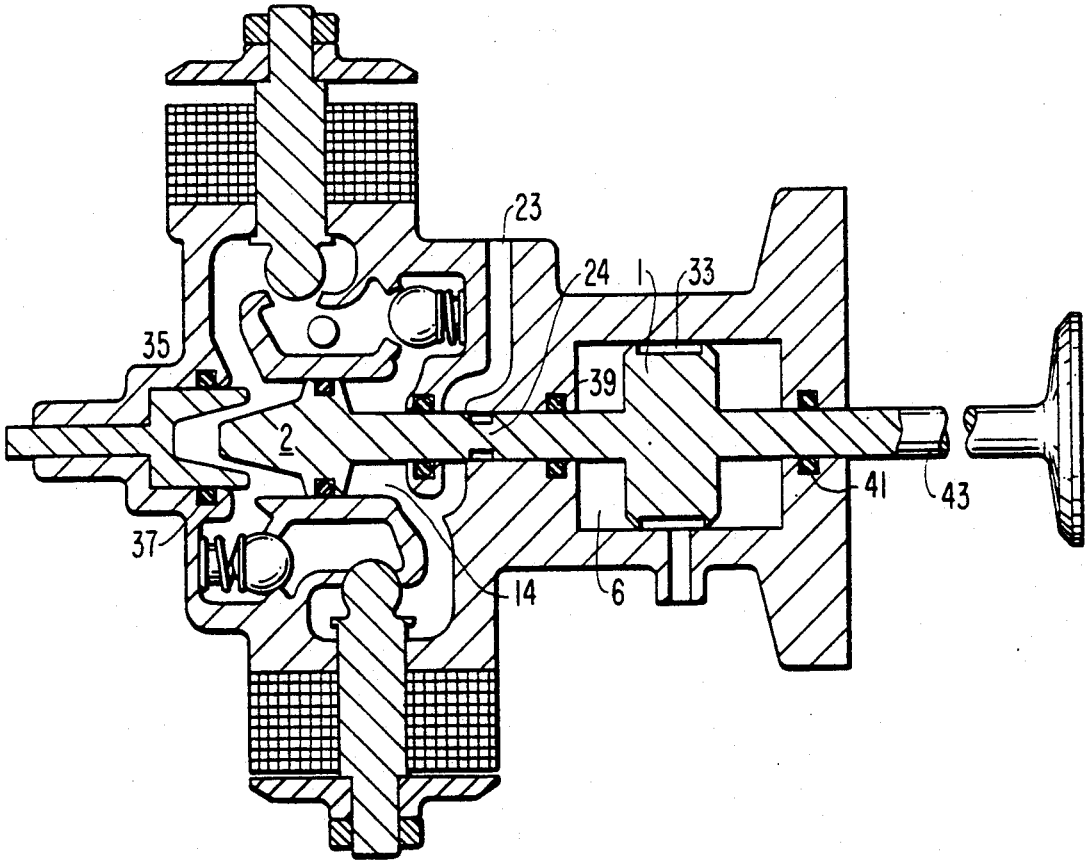
FIG. 6 is a cross-sectional view similar to the earlier views, but showing the valving-in of supplemental hydraulic pressure as the actuator nearing its initial position.

In FIG. 6, the high pressure hydraulic fluid from source 23 is about to be ported into chamber 14 by way of shaft valve 24. The opening of this shaft valve is timed to occur so that this pressure may provide supplemental power to the piston 2 assuring that piston 1 will continue compressing air in chamber 6 until the poppet valve 25 is firmly seated. This supplemental energy compensates for the losses such as sliding friction of seals 33, 35, 37, 39 and 41; the viscous friction of the hydraulic fluid as it circulates between chambers 14 and 18; and other minor actuator losses. Although very high efficiency energy recovery techniques are employed in both directions of actuator travel, the actuator would not completely close and firmly seat the poppet valve 25 without this high pressure "cinching" of the piston 2. Because of the small amount of energy required to offset the frictional losses, only a small hydraulic pump is required to supply this make-up energy.

Following FIG. 6, the actuator returns to its initial position as shown in FIG. 1 with the ball valve 9 still open allowing access to venting port 22 to maintain proper differential pressure on piston 2 and assure proper seating of poppet valve 25.

From the foregoing, it is now apparent that a novel pneumatic actuator arrangement has been disclosed meeting the objects and advantageous features set out hereinbefore as well as others, and that numerous modifications as to the precise shapes, configurations and details may be made by those having ordinary skill in the art without departing from the spirit of the invention or the scope thereof as set out by the claims which follow.

What is claimed is:

1. A bistable pneumatically powered hydraulically latched actuator mechanism comprising:

a reciprocable portion including a power piston and a latching piston having a pair of opposed working surfaces, the power piston and latching piston being movable together back and forth between stable initial and second positions;

symmetric first and second damping chambers in which air is compressed by the power piston alternately during translation of the mechanism portion back and forth between the initial and second positions, compression of the air in either damping chamber slowing the reciprocable portion movement and storing energy for subsequent propulsion of the power piston in an opposite direction;

hydraulic means including the latching piston for temporarily preventing reversal of the direction of movement of the reciprocable portion when the motion of that portion slows to a stop;

means operable on command to disable the hydraulic means and allow the compressed air in a damping chamber to propel the reciprocable portion from one toward the other of its stable positions;

supplemental hydraulic means operable only when the reciprocable portion is near the initial position for supplying additional hydraulic fluid under pressure to apply additional force to one latching piston working surface and assure that the reciprocable portion remains in the initial position until the hydraulic means is disabled.

2. The bistable pneumatically powered hydraulically latched actuator mechanism of claim 1 wherein the supplemental hydraulic means includes a pressure release valve which remains open to vent hydraulic pressure against the other latching piston working surface to a low pressure.

3. The bistable pneumatically powered hydraulically latched actuator mechanism of claim 1 the supplemental hydraulic means is effective to supply additional energy to the mechanism once during each complete cycle to compensate for frictional losses.

4. The bistable pneumatically powered hydraulically latched actuator mechanism of claim 1 further comprising a source of predetermined pressure air for establishing the pre-compression pressure in each of the first and second damping chambers.

5. An electronically controllable pneumatically powered valve actuating mechanism for use in an internal combustion engine of the type having engine intake and exhaust valves with elongated valve stems, the actuating mechanism comprising;

a power piston reciprocable along an axis and adapted to be coupled to an engine valve;

pneumatic motive means for moving the piston, thereby causing the engine valve to move in the direction of stem elongation between valve-closed and valve-open positions; and pneumatic damping means for compressing a volume of air and imparting a continuously increasing decelerating force as the engine valve approaches one of the valve-open and valve-closed positions;

means operable on command for utilizing the compressed volume of air to power the piston back to the other of the valve-open and valve-closed positions; and supplemental hydraulic means operable only when the engine valve is near the valve-closed position for supplying hydraulic fluid under pressure to apply additional force to the engine valve to urge the engine valve securely into the valve-closed position and to supply additional energy to the mechanism once during each complete cycle to compensate for frictional losses.

6. An electronically controllable valve actuating mechanism for use in an internal combustion engine of the type having engine intake and exhaust valves with elongated valve stems, the actuator having a pair of stable positions and comprising;

a power piston having a pair of opposed faces defining variable volume chambers, the power piston being reciprocable along an axis and adapted to be coupled to an engine valve;

resilient damping means including the power piston for imparting a continuously increasing decelerating force as the engine valve approaches either of the valve-open and valve-closed positions;

hydraulic means including a latching piston having a pair or opposed working surfaces, the hydraulic means including a fluid transfer path between the working surfaces of the latching piston and being operable on command to close the fluid transfer path to hold the power piston and engine valve in each of the stable positions, and operable on further command to open the fluid transfer path and allow the resilient damping means to power the piston back from either of the valve-open and valve-closed positions to the other position.

7. A bistable electronically controlled transducer having an armature reciprocable between first and second positions, first pneumatic means for powering the armature from the first position to the second position, second pneumatic means for powering the armature from the second position back to the first position, a first pneumatic spring which is compressed during motion of the armature from the first position to the second position, compression of the first pneumatic spring slowing armature motion as it nears the second position, a second pneumatic spring which is compressed during motion of the armature from the second position to the first position, compression of the second pneumatic spring slowing armature motion as it nears the first position, means for presetting the air pressure in each pneumatic spring at a predetermined value prior to compression, and hydraulic means maintaining pressure on the armature to temporarily prevent reversal of armature motion when the motion of the armature has slowed to a stop.

8. The bistable electronically controlled transducer of claim 7 wherein the first pneumatic means comprises the second pneumatic spring and the second pneumatic means comprises the first pneumatic spring.

9. The bistable electronically controlled transducer of claim 7 further including supplemental hydraulic means operable only when the armature is near the first position for supplying hydraulic fluid under pressure to apply additional force to the armature to urge the armature securely into the first position.

10. The bistable electronically controlled transducer of claim 9 wherein the hydraulic means is disableable on command to allow the compressed first pneumatic spring to power the armature from the first position to the second position, and the hydraulic means and supplemental hydraulic means are disableable on command to allow the compressed second pneumatic spring to return the armature to the second position.

11. The bistable electronically controlled transducer of claim 9 wherein the supplemental hydraulic means is effective to supply additional energy to the mechanism once during each complete cycle to compensate for frictional losses.

* * * * *